US009203195B2

(12) United States Patent
Mueller et al.

(10) Patent No.: US 9,203,195 B2
(45) Date of Patent: Dec. 1, 2015

(54) CONTACT SET FOR A CONNECTION SOCKET

(71) Applicant: MCQ TECH GmbH, Blumberg (DE)

(72) Inventors: Hartmut Mueller, Braeunlingen (DE); Florian Padditz, Engen (DE)

(73) Assignee: MCQ TECH GmbH, Blumberg (DE)

( * ) Notice: Subject to any disclaimer, the term of this patent is extended or adjusted under 35 U.S.C. 154(b) by 0 days.

(21) Appl. No.: 14/248,496

(22) Filed: Apr. 9, 2014

(65) Prior Publication Data

US 2015/0038015 A1 Feb. 5, 2015

(30) Foreign Application Priority Data

Jul. 30, 2013 (DE) ..... 10 2013 108 131

(51) Int. Cl.

| | |
|---|---|
| ***H01R 13/6597*** | (2011.01) |
| ***H01R 13/516*** | (2006.01) |
| ***H01R 13/6464*** | (2011.01) |
| *H01R 13/6467* | (2011.01) |
| *H01R 24/64* | (2011.01) |

(52) U.S. Cl.

CPC ..... *H01R 13/6597* (2013.01); *H01R 13/516* (2013.01); *H01R 13/6464* (2013.01); *H01R 13/6467* (2013.01); *H01R 24/64* (2013.01)

(58) Field of Classification Search

CPC ..... H01R 23/025; H01R 23/005

See application file for complete search history.

(56) References Cited

U.S. PATENT DOCUMENTS

| | | | | |
|---|---|---|---|---|
| 5,716,237 | A | 2/1998 | Conorich et al. | |
| 6,332,810 | B1 * | 12/2001 | Bareel | 439/676 |
| 6,409,547 | B1 * | 6/2002 | Reede | 439/676 |
| 6,443,776 | B2 * | 9/2002 | Reichle | 439/676 |
| 7,038,918 | B2 * | 5/2006 | AbuGhazaleh et al. | 361/780 |
| 7,186,149 | B2 * | 3/2007 | Hashim | 439/676 |
| 7,481,678 | B2 * | 1/2009 | Aekins | 439/620.11 |
| 7,736,195 | B1 * | 6/2010 | Poulsen et al. | 439/676 |
| 7,985,103 | B2 * | 7/2011 | Straka et al. | 439/676 |
| 8,016,621 | B2 * | 9/2011 | Bopp et al. | 439/676 |

(Continued)

FOREIGN PATENT DOCUMENTS

| | | |
|---|---|---|
| DE | 699 25 126 T2 | 10/1999 |
| EP | 1 096 619 A1 | 10/1999 |

OTHER PUBLICATIONS

Office action of German patent office, issued Mar. 25, 2014 (untranslated).

(Continued)

*Primary Examiner* — Gary Paumen
(74) *Attorney, Agent, or Firm* — Juneau & Mitchell

(57) ABSTRACT

The invention relates to a contact set for a connection socket, with the contact set comprising at least two contact elements, with the contact elements comprising at least a first section, a second section, and a third section, with the first section comprising a connection element, with the contact elements being fixed in their relative position to each other by an isolation body in the second section, and with the third section comprising a contact area for a contact element of a plug to be inserted into the connection socket, with at least two of the contact elements comprising a compensation area at a free end of the third section, with two compensation areas being arranged such that they at least partially overlap, with an isolation film being arranged between the two compensation areas and with the isolation film and the two compensation areas being surrounded with an isolating housing.

14 Claims, 4 Drawing Sheets

(56) References Cited

U.S. PATENT DOCUMENTS

| | | | | |
|---|---|---|---|---|
| 8,282,424 | B2 * | 10/2012 | Weinmann et al. | 439/676 |
| 8,826,532 | B2 * | 9/2014 | Caveney et al. | 29/857 |
| 2005/0245125 | A1 | 11/2005 | Colantuono et al. | |
| 2012/0202389 | A1 | 8/2012 | Erickson et al. | |
| 2013/0309916 | A1 * | 11/2013 | Bopp et al. | 439/676 |

OTHER PUBLICATIONS

European Patent Office Search Report, issued Dec. 9, 2014 for parallel European application 14 161609.4 (untranslated).

* cited by examiner 43
42
44
46
41
42
20-1
14
12
22
21

50
52
56
60
59
58
63
60

CONTACT SET FOR A CONNECTION SOCKET

STATEMENT REGARDING FEDERALLY SPONSORED RESEARCH OR DEVELOPMENT

No federal government funds were used in researching or developing this invention.

CROSS REFERENCE TO RELATED APPLICATIONS

This patent application claims priority to German Patent Application 10 2013 108 131.2, filed on Jul. 30, 2013.

NAMES OF PARTIES TO A JOINT RESEARCH AGREEMENT

Not applicable.

SEQUENCE LISTING INCLUDED AND INCORPORATED BY REFERENCE HEREIN

Not applicable.

BACKGROUND

1. Field of the Invention

The invention relates to a contact set for a connection socket

2. Background of the Invention

The current state of knowledge is as follows.

Contact sets for connection sockets, particularly for RJ45-sockets, are known for various transmission capacities. In order to describe the capacity of electronic components they are classified in categories. Presently common categories are Cat-5, which relate to operating frequencies up to 100 MHz, Cat-6, which relate to operating frequencies up to 250 MHz, or Cat-6A, which relate to transmission frequencies up to 500 MHz and are designed for distances up to 100 m. It is also possible that in the future electronic components become common with even better transmission features.

In order for cables or sockets to achieve transmission features according to a certain category, it is required that the near end cross talk (NEXT for short) is suppressed to a certain extent. For this purpose it is known to provide compensation circuits, which reduce or suppress the near end cross talk.

In order to achieve the transmission features of the category 6a for a connection socket, it has been shown that it is advantageous to place a compensation for the cross talk as close as possible next to the contacting point between the socket and a plug inserted in said socket.

For this purpose, EP 1 306 934 B1 provides a socket, fastened on a motherboard, with a compensation circuit board being arranged inside a receiving element of a socket, which comprises a compensation circuit for reducing disturbing influences, particularly cross talk, and at which the contact elements are fastened, which are in contact with the inserted plug, with the motherboard comprising another compensation circuit for reducing disturbing influences.

In order to place a compensation circuit even closer to the contact point between the plug and the socket EP 1 858 118 A1 discloses a socket with a contact set, which shows several contact elements, with a compensation circuit, for example in the form of a flexible substrate with a compensation circuit, being arranged at the free ends of the contact elements, which project into the interior of the socket, into which the plug is inserted.

WO 0180376 A1 discloses a compensation circuit board, arranged in the housing of the socket, flexibly contacted by the free ends of the contact elements, which are fastened with their other end at a circuit board.

The fastening of the circuit boards at the free ends of the contact elements is labor intensive and must occur with a high degree of precision.

The objective of the invention therefore comprises to provide a contact set for a connection socket, which can be produced with low manufacturing costs, and which allows a compensation as close as possible at the contact point between the socket and a plug inserted in the socket.

BRIEF SUMMARY OF THE INVENTION

In a preferred embodiment, a contact set for a connection socket, with the contact set comprising at least two contact elements, with the contact elements comprising at least a first section, a second section, and a third section, with the first section comprising a connection element, with the contact elements being fixed to each other in their relative positions by an isolation body in the second section, and with the third section comprising a contact area for a contact element of a plug to be inserted into a connection socket, wherein at least two of the contact elements comprise a compensation area at a free end of the third section, with two compensation areas being arranged such that they at least partially overlap, with an isolation film being arranged between the two compensation areas and with the isolation film and the two compensation areas being surrounded with an isolating housing.

In another preferred embodiment, the contact set as described, wherein the compensation areas are arranged in one piece at the contact elements.

In another preferred embodiment, the contact set as described, wherein the contact elements with the compensation areas are embodied as punched and bent parts.

In another preferred embodiment, the contact set as described, wherein the isolating housing is injection molded around the compensation areas.

In another preferred embodiment, the contact set as described, wherein at least four of the contact elements comprise a compensation area at a free end of the third section, and two compensation areas each that are arranged such that they at least partially overlap, that an isolation film is arranged between the two pairs of compensation areas, and that one pair of compensation areas each, with the isolation film located between them, is surrounded with an isolating housing.

In another preferred embodiment, the contact set as described, wherein the contact set comprises eight contact elements, which are arranged serially next to each other, with the central four contact elements comprising compensation areas and with particularly the two central contact elements being arranged in spatial proximity of the compensation areas cross-wise in reference to each other.

In another preferred embodiment, the contact set as described, wherein the contact set is suitable for operating frequencies up to 500 MHz and fulfills the requirements of Cat-6A.

In another preferred embodiment, the contact set as described, wherein the contact set comprises a first section in which at least two contact elements are arranged cross-wise in reference to each other.

In another preferred embodiment, the contact set as described, wherein the contact set comprises a second section, in which the contact elements are guided parallel in reference to each other, and at least two of the contact elements show a distance in reference to each other different from that in the first section or in the third section.

In another preferred embodiment, the contact set as described, wherein the isolation body comprises at least one insertion element for insertion into a socket housing.

In another preferred embodiment, the contact set as described, wherein the isolation body comprises at least one latch element for fixation in a socket housing.

In another preferred embodiment, the contact set as described, wherein the isolation body is injection molded around the contact elements.

In another preferred embodiment, a connection socket comprising the contact set as described.

In another preferred embodiment, a connection jack or distribution panel comprising at least one connection socket comprising the contact set as described.

In another preferred embodiment, a connection jack or distribution panel with at least one motherboard comprising at least one connection socket with the contact set as described, with the motherboard comprising at least one terminal element and at least one connection element for an electrically conductive connection of one of the contact elements of the contact set to the connection element, wherein a first cable can be connected in the connection socket and a second cable, particularly a stationary laid cable, to the connection element, and with the motherboard comprising at least one compensation element.

DETAILED DESCRIPTION OF THE INVENTION

Figure 1:
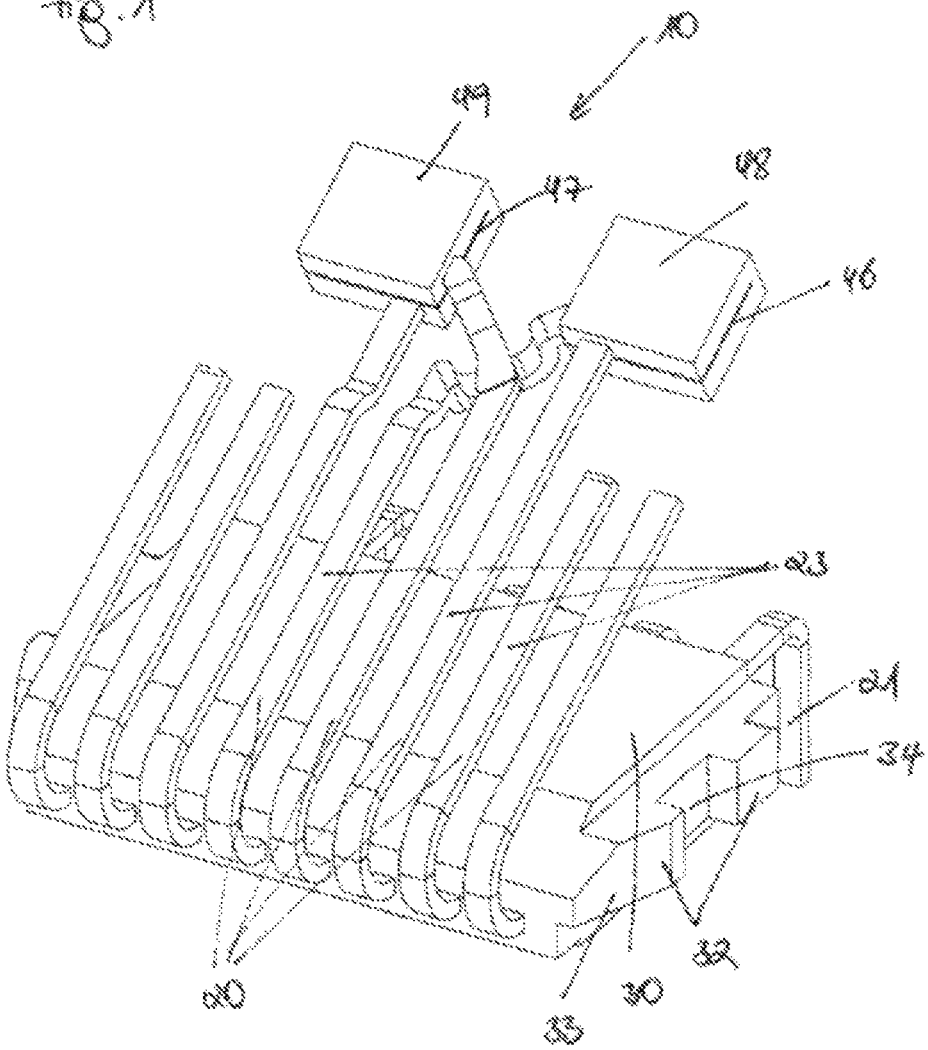
FIG. 1 is a line drawing evidencing a perspective view of a contact set according to an exemplary embodiment of the invention.

According to the invention the objective is attained in a contact set for a connection socket with the features of claim 1.

Advantageous embodiments and further developments of the invention are disclosed in the dependent claims.

The contact set according to the invention for a connection socket, with the contact set here comprising at least two contact elements, and with the contact elements comprising at least a first section, a second section, and a third section, with the first section in turn comprising a connection element, with the contact elements being fixed in their relative position in reference to each other by an isolation body in the second section, and with the third section comprising a contact area for a contact element of a plug inserting into the connection socket, is characterized in that at least two of the contact elements comprise a compensation area at a free end of the third section, with two compensation areas being arranged such that they overlap at least partially, with an isolation film being arranged between the two at least partially overlapping compensation areas, and with the isolation film and the two compensation areas being surrounded by an isolation housing. By the arrangement of the compensation areas at the contact elements an expensively produced circuit board and an expensive placement of the circuit board can be omitted for the contact elements. Nevertheless, the option remains for compensation in a spatial proximity of the contact point between the socket and a plug inserted in the socket, because the compensation areas are arranged at a free end of the third sections.

According to a particularly preferred embodiment of the invention, the compensation areas are arranged in one piece at the contact elements, which in considerably simplifies the production.

An advantageous embodiment of the invention provides that the contact elements with the compensation areas are embodied as punched and bent-parts, allowing the simplification of the production.

It is particularly preferred that the isolating housing is injection-molded around the compensation areas, which contributes to the simplification of the production process.

Advantageously, at least four of the contact elements comprise a compensation area at a free end of the third section, with two compensation areas each being arranged such that they at least partially overlap, with an isolating film being arranged between the two pairs of compensation areas, and with each pair of compensation areas with the isolation film between them being surrounded by an isolating housing. This way, two compact packages form at the contact set, comprising the compensation areas.

Advantageously, the contact set comprises eight contact elements, which are arranged serially next to each other, with the central four contact elements comprising compensation areas, and with particularly the two central contact elements being arranged cross-wise in spatial proximity of the compensation areas. This allows a space-saving design of the contact set.

Advantageously, the contact set is suitable for operating frequencies up to 500 MHz and fulfills particularly the requirements of the category 6A.

According to a particularly preferred embodiment of the invention, the contact set comprises a first section in which at least two contact elements are arranged crossing each other. This way, a certain compensation of the near end cross talk is achieved by the arrangement of the contact elements in the contact set, which is particularly advantageous for achieving the transmission features of the category 6a.

A preferred embodiment of the invention provides that the contact set comprises a second section in which the contact elements are guided parallel in reference to each other and at least two of the contact elements show a distance from each other which is different from the [distance] in the first section or in the fourth section. This embodiment leads to a certain compensation of the near end cross talk by the arrangement of the contact elements of the contact set, improving the transmission features and particularly improving the achievement of the transmission features of the category 6a.

Preferably the isolation body comprises at least one insertion element for inserting into a socket housing, which facilitates the insertion of the contact set into the socket housing of a connection socket.

Preferably the isolation body comprises at least one latch element for the fixation in a socket housing in order to allow a simple fastening of the contact set in a socket housing.

Preferably, the isolation body is injection molded around the contact elements, which simplifies the production.

A connection socket according to the invention, which particularly comprises a housing and a receiving opening to accept a socket of a data cable, with the isolation body and the third section of the contact elements of the contact set forming an acute angle, which opens towards the wall of the housing opposite the receiving opening, comprises a contact set according to the invention.

A connection socket according to the invention or a distribution field according to the invention comprises at least one connection socket according to the invention with a contact set according to the invention, with the connection socket being fastened in the connection jack or the distribution field, preferably on a motherboard, and the motherboard comprising at least one connection element for the production of an electrically conductive connection of one of the contact elements of the contact set to the connection element, where a first cable can be connected in the connection socket and a second cable, particularly a stationary laid cable, can be connected to the connection element, and with the motherboard comprising at least one compensation element. Connection sockets or distribution fields, also called patch fields or patch panels, serve for the production of a high-performance data transmission connection between lines of a stationary laid data cable, for example in the wall of a building, and another data cable, particularly a flexible one, and are used for the distribution of data cables, for example network cables, telephone cables, or fiber optic cables.

DETAILED DESCRIPTION OF THE FIGURES

FIG. 1 shows a perspective view of an exemplary embodiment of a contact set 10 with several, particularly eight contact elements 20-1, 20-2, 20-3, 20-4, 20-5, 20-6, 20-7, 20-8, in general marked 20, and an isolation body 30, which fixes the contact elements 20 in their position in reference to each other. The contact elements 20 are made from an electrically conductive material, the isolation body from an isolating material, for example plastic. In particular, the isolation body 30 is injection molded around the contact elements 20.

The contact elements 20 comprise a first section 21, a second section 22, and a third section 23. Here, it should particularly be pointed out that the sections 21, 22, 23 do not necessarily abut each other directly; rather, they also may be embodied partially or entirely overlapping.

The first section 21 comprises a connection element, which in the present case is particularly embodied as a connection pin.

In the second section 22 the contact elements 20 are surrounded by the isolation body 30 and fixed in their relative position to each other. Here, the first section 21 is bent in reference to the second section 22 of the contact elements 20, particularly by 45° or 90°.

The third section 23 of the contact element 20 comprises a contact area for a contact element of a plug. Here, the third sections 23 are bent in reference to the second sections 22 such that they form a preferably acute angle with the second sections 22 or the surfaces of the isolation body 30. The third sections 23 are particularly embodied such that they can contact the contact elements of the plug under the stress of a spring force.

When the contact elements 20 are arranged in the isolation body 30, particularly the first sections 21 of all contact elements 20 and the third sections 23 of all contact elements 20 are aligned parallel in reference to each other. In particular, at least the three sections 23 of the contact elements 20 may be arranged equidistantly.

The isolation body 30 may essentially be embodied as a cubic element. In one embodiment the isolation body 30 comprises at least one insertion element 32, which facilitates the insertion and positioning of the contact set 10 in a socket housing 52 of a connection socket 50. Here, the insertion elements 32 can be embodied such that they engage guiding grooves 58, which are arranged in the socket housing 52. In a preferred embodiment the insertion elements 32 comprise a bevel 33, which further facilitates the insertion into the socket housing 52, particularly into the guiding groove 58 of the socket housing 52.

In one embodiment the isolation body 30 comprises at least one, for example two latch elements 34, with which the isolation body 30 can latch in the socket housing 52. The latch elements 34 may be embodied as undercuts in the insertion elements 32, for example, in order to facilitate the production.

Figure 2:
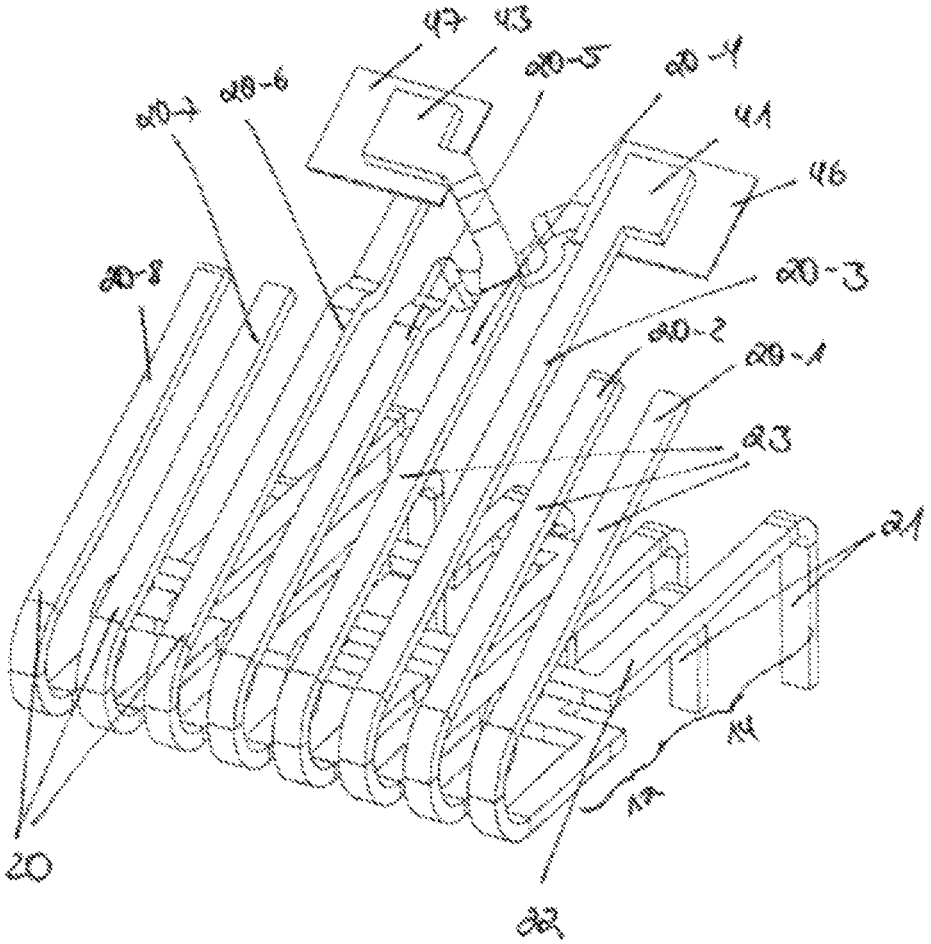
FIG. 2 is a line drawing evidencing the contact elements of the contact set according to FIG. 1 with isolating films positioned between them.
Figure 3:
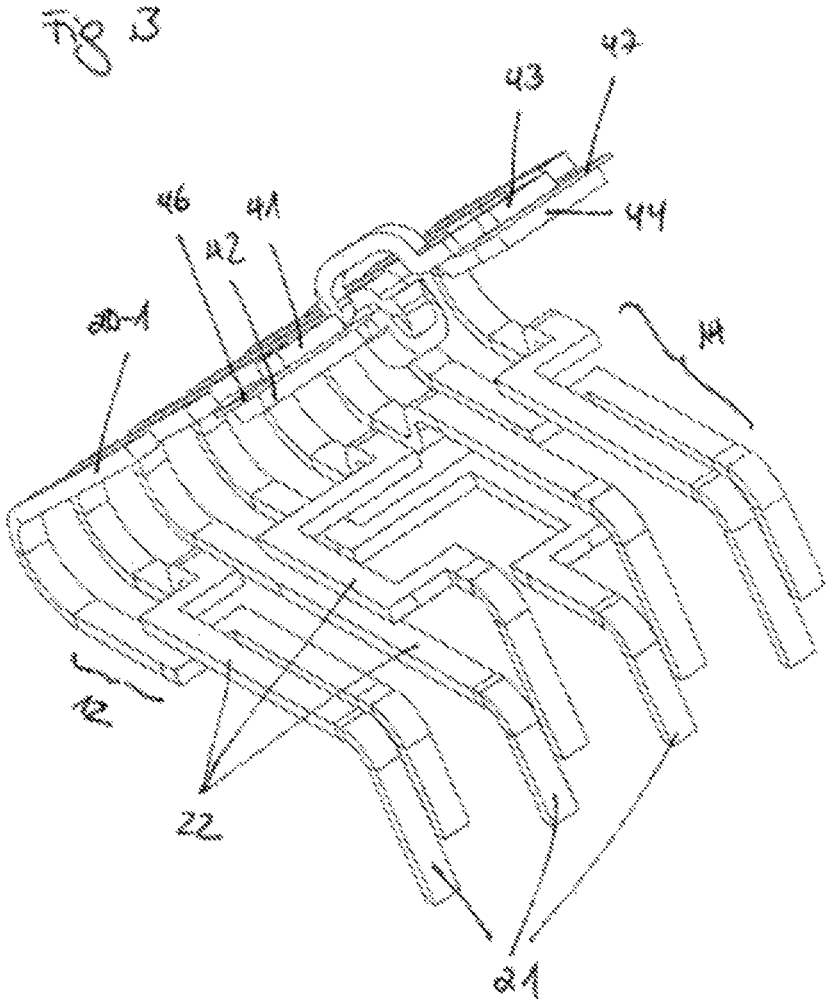
FIG. 3 is a line drawing evidencing another perspective view of the contact elements with isolating films of the contact set according to FIG. 1 positioned between them.

The contact set 10 with the contact elements 20 and the isolation body 30 comprises defined transmission features. They may be influenced and improved in a targeted fashion by a guidance as shown in FIGS. 2 and 3 and a cross-wise arrangement of the different contact elements 20, particularly in the second sections 22.

In one embodiment at least two of the contact elements 20, for example the contact elements 20-1, 20-2, and/or the contact elements 20-4, 20-5 and/or the contact elements 20-7, 20-8 may be arranged cross-wise in reference to each other in a section 12 of the contact set 10. The section 12 is particularly arranged in the isolation body 30 and is particularly located in the second section 22 of the contact elements 20. By crossing the contact elements 20 a targeted counter-coupling can be achieved, by which the near end cross talk can be reduced.

Additionally, in order to reduce near end cross talk in the contact set 10, in a second section 14 of the contact set 10 at least two of the contact elements 20 may show a different distance from each other than the distance at which their first sections 21 or their third sections 23 are arranged in reference to each other. Counter coupling can also be achieved by such a targeted guiding of the contact elements 20 at a smaller or greater distance from each other, which reduces the near end cross talk in the contact set 10. The second section 14 particularly follows the first section 12 and contacts particularly the second section 22 of the contact elements 20. In particular the second section 14 is surrounded at least sectionally by the isolation body 30. The embodiment of the contact set 10 with the guidance for the contact elements 20 in the first section 12 and/or the second section 14 improves the transmission features; however, this represents an optional embodiment.

In order to improve the transmission features of the contact set 10 at least two of the contact elements 20, particularly precisely four contact elements 20, for example the four central contact elements 20-3, 20-4, 20-5, 20-6, comprise a compensation area 41, 42, 43, 44 at a free end of the third sections 23. For this purpose, the third sections 23 of the respective contact elements 20-3, 20-4, 20-5, 20-6 are embodied longer than the third sections 23 of the contact elements 20-1, 20-2, 20-7, 20-8, which show no compensation area. The compensation area 41 is arranged at the third contact element 20-3, the compensation area 42 at the fifth contact element 20-5, the compensation area 43 at the fourth contact element 20-4, and the compensation area 44 at the sixth contact element 20-6. Two compensation areas 41, 42; 43, 44 each are arranged such that they overlap at least partially. For this purpose, particularly the free ends of the third sections 23 of the respective contact elements 20-3, 20-4, 20-5, 20-6 are aligned to each other. For example, the free ends of the contact elements 20-4, 20-5 are bent. In particular the free ends of the third sections 23 of the contact elements 20-4, 20-5 are arranged cross-wise in reference to each other. The contact areas 41, 42 of the contact elements 20-3, 20-5 may overlap each other and form a pair, while on the other side the contact areas 43, 44 of the contact elements 20-4, 20-6 overlap and form another pair.

One isolation film 46, 47 each is arranged between the pairs of contact elements 41, 42; 43, 44. The two compensation areas 41, 42 with the isolation film 46 located between them form a first compensation element, particularly a first condenser, while the two compensation areas 43, 44 with the film 47 located between them form a second compensation element, particularly another condenser. For the purpose of stabilization the two compensation areas 41, 42 with the isolation film 46 positioned between them are surrounded by a first isolating housing 48, while the compensation areas 43, 44 with the film 47 positioned between them are surrounded by a second isolating housing 49. The isolating housings 48, 49 are preferably produced by way of injection molding.

In one embodiment the compensation areas 41, 42, 43, 44 are arranged in one piece at the contact elements 20-3, 20-5, 20-4, 20-6. This way it is particularly possible to embody the contact elements 20 as a punched and bent part.

The transmission features of electronic components are classified in categories, with presently the categories 5, 6, and 6A being particularly common. By the compensation areas 41, 42, 43, 44 for example the transmission features of the contact set 10 can be increased by one or more categories.

In particular, the contact set 10 is embodied such that it fulfills the transmission features of the category 6A with the compensation areas 41, 42, 43, 44.

Figure 4:
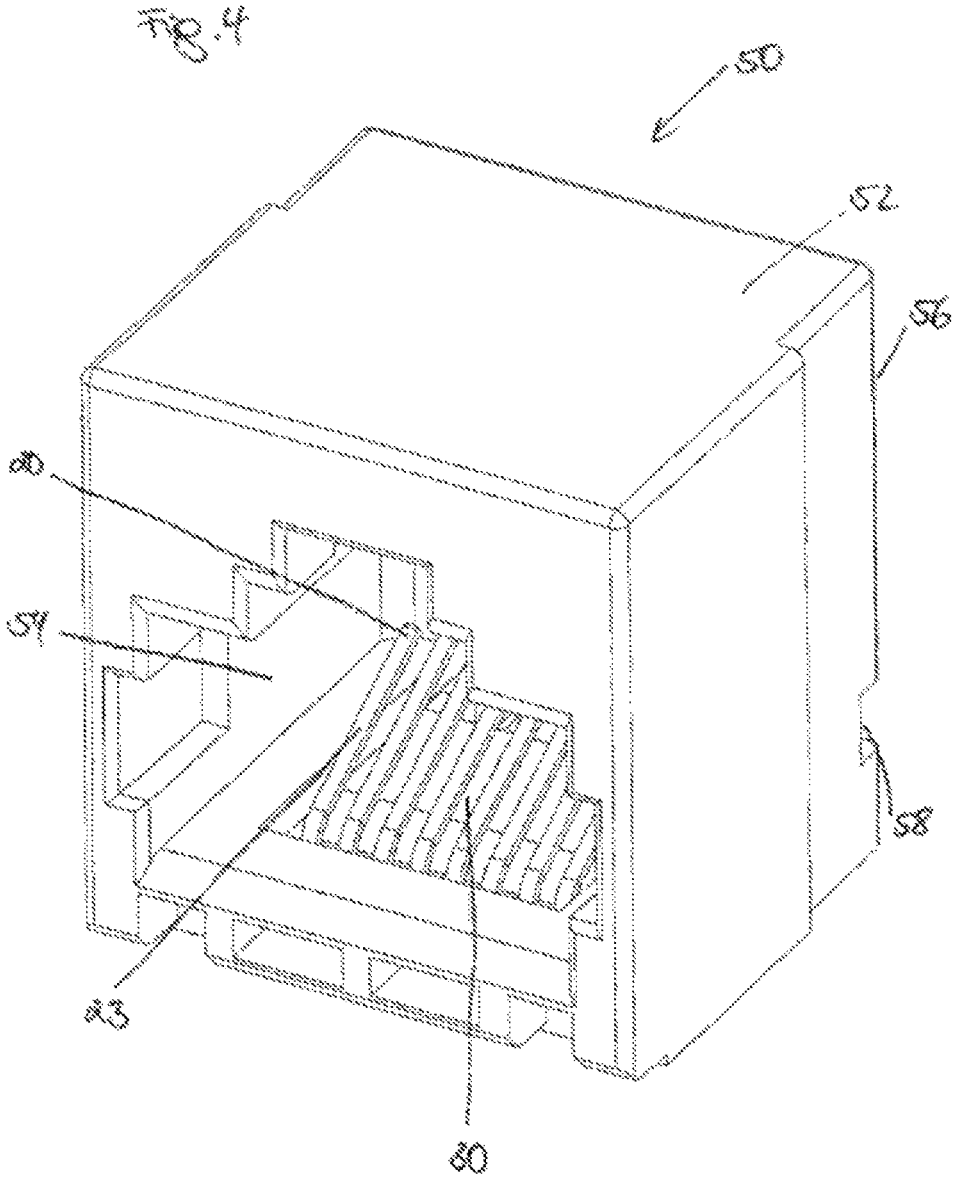
FIG. 4 is a line drawing evidencing a perspective view of a connection socket with a contact set according to FIG. 1.

The FIGS. 3 and 4 show the connection socket 50 with the socket housing 52, in which the contact set 10 is inserted according to FIG. 1. The connection socket 50 comprises a receiving opening 54 at its front, in which a plug of a cable to be connected can be inserted. The plug can particularly be inserted such that the contact elements of the plug to be inserted into the connection socket 50 contacts the contact elements 20, particularly the third sections 23 of the contact elements 20. The contact set 10 is arranged in the socket housing 52 such that the acute angle forming between the isolation body 30 and the third section 23 opens towards a wall 56, arranged opposite the receiving opening 54. This way, a contact set 10 is inserted from the wall 56 into the socket housing 52, where the contact set 10 latches via the latch elements 34 in the socket housing 52.

Such a connection socket 50 can particularly be used in connection jacks or distribution panels, which are also called relay fields, patch fields or the like. Here, one or more connection sockets 50 may be arranged on a motherboard. The motherboard may show at least one connection element and at least one connection element for generating an electrically conductive connection of the first section 21 of the contact element 20 of the contact set 10 to the connection element, where a first cable can be connected in the connection socket 50 and a second cable, particularly a stationary laid cable, to the connection element. The motherboard preferably comprises at least one compensation element in order to allow an additional compensation of interfering effects upon the motherboard.

In a preferred embodiment, contact set 10 is suitable for operating frequencies up to 500 MHz, particularly that it fulfills the requirements of Cat-6A.

LIST OF REFERENCE NUMBERS

10 Contact set
12 First section
14 Second section
20 Contact element
20-1 Contact element
20-2 Contact element
20-3 Contact element
20-4 Contact element
20-5 Contact element
20-6 Contact element
20-7 Contact element
20-8 Contact element
21 First section
22 Second section
23 Third section
30 Isolation body
32 Insertion element
33 Bevel
34 Latch element
41 First compensation area
42 Second compensation area
43 Third compensation area
44 Fourth compensation area
46 First isolation film
47 Second isolation film
48 Housing
49 Housing
50 Connection socket
52 Socket housing
54 Receiving opening
56 Wall
58 Guiding groove The references recited herein are incorporated herein in their entirety, particularly as they relate to teaching the level of ordinary skill in this art and for any disclosure necessary for the commoner understanding of the subject matter of the claimed invention. It will be clear to a person of ordinary skill in the art that the above embodiments may be altered or that insubstantial changes may be made without departing from the scope of the invention. Accordingly, the scope of the invention is determined by the scope of the following claims and their equitable Equivalents.

We claim:

1. A contact set for a connection socket, with the contact set comprising at least two contact elements, with the contact elements comprising at least a first section, a second section, and a third section, with the first section comprising a connection element, with the contact elements being fixed to each other in their relative positions by an isolation body in the second section, and with the third section comprising a contact area for a contact element of a plug to be inserted into a connection socket, wherein at least two of the contact elements comprise a compensation area at a free end of the third section, with two compensation areas being arranged such that they at least partially overlap, with an isolation film being arranged between the two compensation areas and with the isolation film and the two compensation areas being surrounded and held in a fixed position with regard to one another by an isolating housing.

2. The contact set of claim 1, wherein the compensation areas are arranged in one piece at the contact elements.

3. The contact set of claim 1, wherein the contact elements with the compensation areas are embodied as punched and bent parts.

4. The contact set of claim 1, wherein the isolating housing is injection molded around the compensation areas.

5. The contact set of claim 1, wherein at least four of the contact elements comprise a compensation area at a free end of the third section, and two compensation areas each that are arranged such that they at least partially overlap, that an isolation film is arranged between the two pairs of compensation areas, and that one pair of compensation areas each, with the isolation film located between them, is surrounded with an isolating housing.

6. The contact set of claim 1, wherein the contact set comprises eight contact elements, which are arranged serially next to each other, with the central four contact elements comprising compensation areas and with particularly the two central contact elements being arranged in spatial proximity of the compensation areas cross-wise in reference to each other.

7. The contact set of claim 1, wherein the contact set is suitable for operating frequencies up to 500 MHz and fulfills the requirements of Cat-6A.

8. The contact set of claim 1, wherein the contact set comprises a first section in which at least two contact elements are arranged cross-wise in reference to each other.

9. The contact set of claim 1, wherein the contact set comprises a second section, in which the contact elements are guided parallel in reference to each other, and at least two of the contact elements show a distance in reference to each other different from that in the first section or in the third section.

10. The contact set of claim 1, wherein the isolation body comprises at least one insertion element for insertion into a socket housing.

11. The contact set of claim 1, wherein the isolation body comprises at least one latch element for fixation in a socket housing.

12. The contact set of claim 1, wherein the isolation body is injection molded around the contact elements.

13. A connection socket comprising the contact set of claim 1.

14. A connection jack or distribution panel comprising at least one connection socket comprising the contact set of claim 1.

* * * * *